United States Patent [19]

Corrigan et al.

[11] 4,427,118

[45] Jan. 24, 1984

[54] CARPET DISPLAY STAND

[75] Inventors: James L. Corrigan; Deborah L. Howett, both of Lancaster; Gerard M. Schouten, Lititz, all of Pa.

[73] Assignee: Armstrong World Industries, Inc., Lancaster, Pa.

[21] Appl. No.: 298,588

[22] Filed: Sep. 2, 1981

[51] Int. Cl.[3] ..... A47F 7/16

[52] U.S. Cl. ..... 211/45; 312/312

[58] Field of Search ..... 211/45; 312/289, 253, 312/208, 312; 248/346, 357

[56] References Cited

U.S. PATENT DOCUMENTS

| | | | |
|---|---|---|---|
| 1,299,783 | 4/1919 | Rush | 211/45 |
| 1,720,879 | 7/1929 | Best | 211/45 |
| 2,608,777 | 9/1952 | Schuler | 211/45 X |
| 2,643,774 | 6/1953 | Patterson et al. | 211/45 |
| 2,879,898 | 3/1959 | Best | 211/45 |
| 2,919,812 | 1/1960 | Best et al. | 211/45 |
| 4,038,767 | 8/1977 | Chasin | 211/45 X |
| 4,292,903 | 10/1981 | Hockema | 312/312 |

*Primary Examiner*—William E. Lyddane
*Assistant Examiner*—Peter A. Aschenbrenner

[57] ABSTRACT

A carpet display stand having a base made of two telescoping parts which are adjustable to provide a display stand of variable heights. On top of the base there is mounted an inclined flat top. The front edge of the top is provided with an open area for the display of information on the carpet positioned on the display stand. The back end of the top is positioned by a cut-away portion of the base so that carpet samples may be positioned with their ends in this cut-away area and they may be flipped over into this cut-away area. Carpet samples are releasably clamped to the flat top.

5 Claims, 3 Drawing Figures

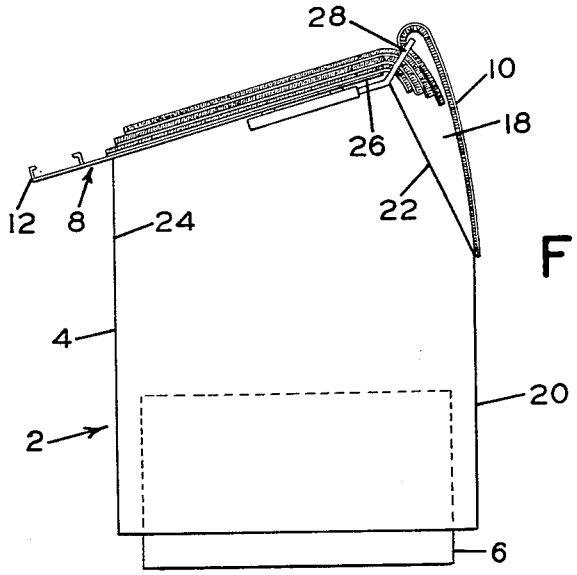
FIG. 1
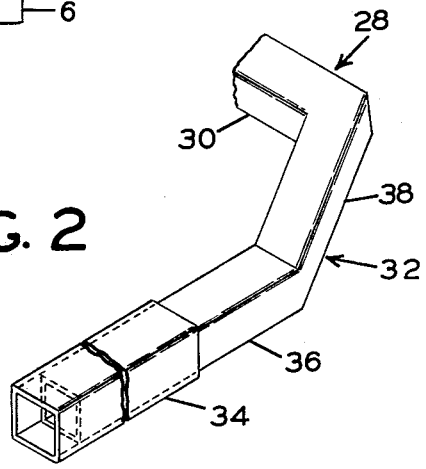
FIG. 2
FIG. 3
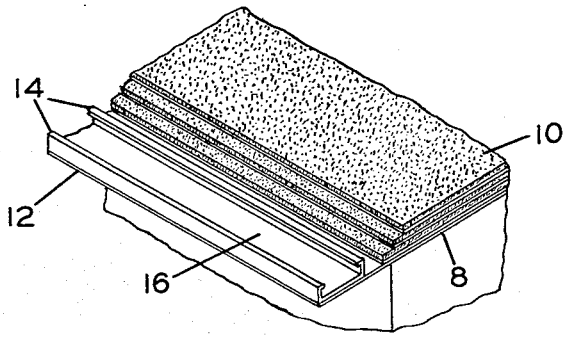

CARPET DISPLAY STAND

BACKGROUND OF THE INVENTION

1. Field of the Invention

The invention is directed to a display stand for carpet products.

2. Description of the Prior Art

Design Pat. No. 223,005 discloses a table that has what appears to be a two-part base structure.

U.S. Pat. No. 2,879,889 discloses a carpet display stand with a means for clamping carpets in position on a square-type base.

Summary of the Invention

The invention is directed to a display stand for use with carpeting. The stand consists of a flat top inclined at an angle to the horizontal. At one end of the top, there is a clamping means for holding carpet samples on the top with the carpet samples being restrained at one end thereof. At the opposite end of the top, there is a portion of the top left uncovered by carpet samples and some means is provided in that area for supporting descriptive material which describes the characteristics of the carpet positioned on the display stand. The stand also consists of a base for supporting the flat top. The base is a two-part structure with the first part supporting the flat top on the upper end thereof. The second part of the base telescopes inside said first part of the base at the lower end thereof. Means is provided to adjustably retaining the second part within the first part at various positions relative to the lower end of the first part so that the base structure is adjustable as to variable heights. The base structure, and particularly the first part thereof, is made with four vertical sides and a top surface inclined to position said flat top in an inclined position. A portion of the base adjacent the back end of the flat top is cut away to provide a recessed area. In other words, the vertical side adjacent the back end of the top having the clamping means is provided with an inclined upper end portion. This inclined portion extends in a direction towards the opposite side of the base and provides a cut-out region.

The cut-out region is particular important in that it provides for a shifting of the center of balance of the carpet samples, at rest or when they have been flipped over so that one may see the bottom carpet sample, to a point within the base of the display stand instead of at a position at the back edge of the display stand. The use of a means for holding display material at the front edge of the carpet samples is particular unique in the art since most display stands contain no descriptive information, and the only way one learns about the carpet samples is to flip the carpet samples over and look at a label on the backside of the carpet samples.

BRIEF DESCRIPTION OF THE DRAWING

FIG. 1 is a side view of the display stand;

FIG. 2 is a perspective view of a portion of the carpet clamping structure; and FIG. 3 is a perspective of the front end of the top of the display stand.

DESCRIPTION OF THE PREFERRED INVENTION

The invention is directed to a display stand which is particularly adapted for displaying carpet products. The invention provides several unique features.

The first unique feature is the provision of an open area on the front part of the flat top of the display stand for the sole purpose of permitting the carpet retailer to insert therein a cardboard strip containing detailed descriptive information of the carpet samples. Normally, the only way one learns anything about the nature of the carpet samples being displayed was to turn the carpet samples over on their backside and look at the label on the back of the carpet samples. The information that is normally provided on the back of the carpet could be provided on the cardboard on the front of the top of the carpet display stand, and thus greatly assist both the retailer and the purchaser in identifying the qualities of the carpet samples they are looking at.

The carpet stand is adjustable as to height and provides a cut-out at the back edge thereof into which a portion of the carpet samples may rest or may be flipped when one is flipping down through the stack of carpets to look at the different samples. If the carpet samples were flipped over one side of the display stand, the center of gravity of the display stand would gradually shift to that edge as the carpet samples are flipped over. Because of substantial concern from the Occupational Health and Safety laws, it is important that display stands not be capable of being easily knocked over whereby they may fall upon a child or fall upon the leg of an employee or customer in a store. The cut-out area shifts the carpet samples ends at the clamped end forward from the back edge of the display base and also provides an area into which the carpet samples will fall as they are flipped over, and thus this maintains the center of gravity of the carpet stand at all times well within the base of the carpet display stand. Therefore, the display stand is not capable of being easily tipped over and result in damage to a person near the carpet stand.

The carpet stand base 2 as shown in FIG. 1 is composed of a first part 4 and a second part 6. The second part 6 telescopes inside the lower edge of the part 4. Conventional means, such as screws or bolts, will be used to fasten together the part 6 and the part 4 so that they may be releasably held together and adjusted to various positions so that the carpet display base may be of variable heights. The top edge of the base 4 is provided with a flat inclined surface on which is positioned the flat top 8 containing the carpet samples. The carpet samples 10 are positioned on the flat top. The flat top is inclined at an angle to the horizontal and the carpet samples, as shown in FIG. 3 are so positioned so that the lower end 12 of the flat top 8 is not covered by the carpet samples. In this region 12, there may be positioned some type of means for positioning printed material which describes the carpet samples. A very simple form of means for supporting descriptive material would be two inverted L-shaped structures 14 which define therebetween a channel structure 16. Into this channel structure 16 may be slipped a piece of cardboard upon which will be provided descriptive material describing the qualities of the carpet samples on the display stand.

Another unique feature is the provision of the cutaway 18 at the back edge of the display stand. As indicated above, this cut-away area 18 is used to control the center of balance of the carpet display stand when the carpet samples are at rest or all the carpet samples are flipped back into the position shown in FIG. 1. The carpet display stand has actually four sides. The vertical side 20 which is at the back of the display stand has at its upper end an inclined surface 22 which is inclined away from the plane of the vertical side 20 in the direction towards the opposite vertical side 24. This thus spaces the one end 26 of the flat top several inches away from the vertical plane of the side 20. This structure defines the cut-out area 18 at the backside of the carpet display stand where the carpet samples are clamped. The clamped ends of the carpet samples hang into the recessed area and flipped over carpet samples are partly in the recessed area.

Finally a means is provided to clamp the carpet samples in position. This clamp 28 is a U-shaped structure having a horizontal bar 30 which passes across the carpet samples beyond the back edge of the flat top 8 and presses against the carpet samples to hold them against the back edge of the flat top. The clamping means 28 has two legs 32 which extend parallel with the sides of the carpet samples and the flat top. The legs 32 slide into holders 34, one on each side of the flat top. The legs 32 may be frictionally held within the holders 34 or a set screw arrangement could be provided to fasten the leg 32 in position in the holder 33. The leg 32 is composed of two parts, one part 36 which slides into the holder 33 and another part 38 which is angled relative to 36 so that the bar 28 is positioned in its right position to hold the carpet samples in position on the flat top against the back edge of the flat top.

Contrary to most other "waterfall" type carpet displays whose carpets are held in place by the downward action of the clamping device, this carpet display stand has been designed with a clamping bar that mounts on an angle, thereby moving the clamping point further to the back of the carpet samples allowing a larger portion of the carpet to be visable when the customer pages through the samples as shown in FIG. 1. This location of the clamping bar also makes it easier for the customer to turn the samples because more carpet overhangs the clamping bar when the sample is thrown back, reducing the tendency for the carpet sample to fall forward. This movement of the bar 30 further to the back of the carpet samples is due to the two part leg structure 36 and 38.

What is claimed is:

1. A display stand with carpet samples consisting of:

(a) a flat top inclined at an angle to the horizontal, (1) at one end of said top there being a clamping means for holding carpet samples on said top with said samples restrained at one end thereof, (2) at the opposite end of said top there being a portion of the top uncovered by said carpet samples and said portion of said top uncovered having means for supporting descriptive material thereon; and (b) a base for supporting said flat top, (1) said base having a first part which supports the flat top on the upper end thereof, and a second part which telescopes inside said first part at the lower end thereof and means of releasably retaining said second part within said first part at various positions relative to the lower end of the first part, (2) said first part having four parallel vertical sides and a top surface inclined to position said flat top in an inclined position, said one vertical side, adjacent the one end of said top having said carpet clamping means, having the upper end portion thereof inclined away from the plane of that said one vertical side in a direction towards the opposite vertical side whereby the one end of said flat top is spaced several inches away from the vertical plane of said one vertical side and said one end of said flat top is spaced over the main portion of the body of the base and not the one vertical side with the inclined upper end.

2. A display stand as set forth in claim 1 wherein the means for supporting descriptive material is a mounting means having two adjacent inverted L-shaped means facing each other, said means providing a channel into which a flat surface elongated card may be positioned and retained.

3. A display stand as set forth in claim 1 wherein the clamping means for holding carpet samples is a U-shaped structure with the base of the U-shaped structure overlying the plane of the flat top and with the legs thereof extending parallel with the two sides of the flat top, said legs being retained by holders on the sides of the flat top whereby the clamping means can retain carpet samples on the flat top.

4. A display stand as set forth in claim 3 wherein the clamping means holds carpet samples in position on the flat top and the carpet sample ends nearest the clamping means rest in an area above the inclined upper end of the one vertical side.

5. A display stand as set forth in claim 3 wherein the legs of the clamping means are in two parts with one part of a leg extending parallel with the carpet samples and the second part of a leg being angled relative to the first part to position the base of the U-shaped structure beyond the back edge of the flat top to hold the carpet samples against the back edge of the flat top.

* * * * *